United States Patent [19]

Matsumoto et al.

[11] 4,381,072

[45] Apr. 26, 1983

[54] METHOD AND DEVICE FOR SEPARATELY COLLECTING COMPONENTS OF A LIQUID BY MEANS OF A CENTRIFUGAL ROTOR

[75] Inventors: Tetsuo Matsumoto, Hyogo; Akira Okumura, Takarazuka, both of Japan

[73] Assignee: Atto Corporation, Tokyo, Japan

[21] Appl. No.: 252,417

[22] Filed: Apr. 9, 1981

[30] Foreign Application Priority Data

Apr. 11, 1980 [JP] Japan ..... 55-48287

[51] Int. Cl.[3] ..... B04B 7/00; B04B 15/08

[52] U.S. Cl. ..... 494/10; 422/72; 494/27; 494/37; 494/85

[58] Field of Search ..... 233/1 R, 13, 19 R, 21, 233/34, 38, 40, 27, 28, 16, 14 R, 14 A, 17; 137/888, 892, 894

[56] References Cited

U.S. PATENT DOCUMENTS

| | | | |
|---|---|---|---|
| Re. 21,168 | 8/1939 | Coutor | 233/18 X |
| 1,113,426 | 10/1914 | Galloway | 137/888 X |
| 3,327,727 | 6/1967 | Anastasia | 137/888 X |
| 3,439,871 | 4/1969 | Unger | 233/21 X |
| 4,056,224 | 11/1977 | Lolachi | 233/14 R |
| 4,091,989 | 5/1978 | Schlutz | 233/14 R |
| 4,154,793 | 5/1979 | Guigan | 233/27 X |

*Primary Examiner*—Harvey C. Hornsby
*Assistant Examiner*—Christine A. Peterson
*Attorney, Agent, or Firm*—Brumbaugh, Graves, Donohue & Raymond

[57] ABSTRACT

Method and device for centrifugal separation of components of a liquid in which the liquid components are separated under the action of centrifugal force and then separately collected under the action of aspirator mechanism.

9 Claims, 6 Drawing Figures

FIG. 2 (II)

Figure 2:
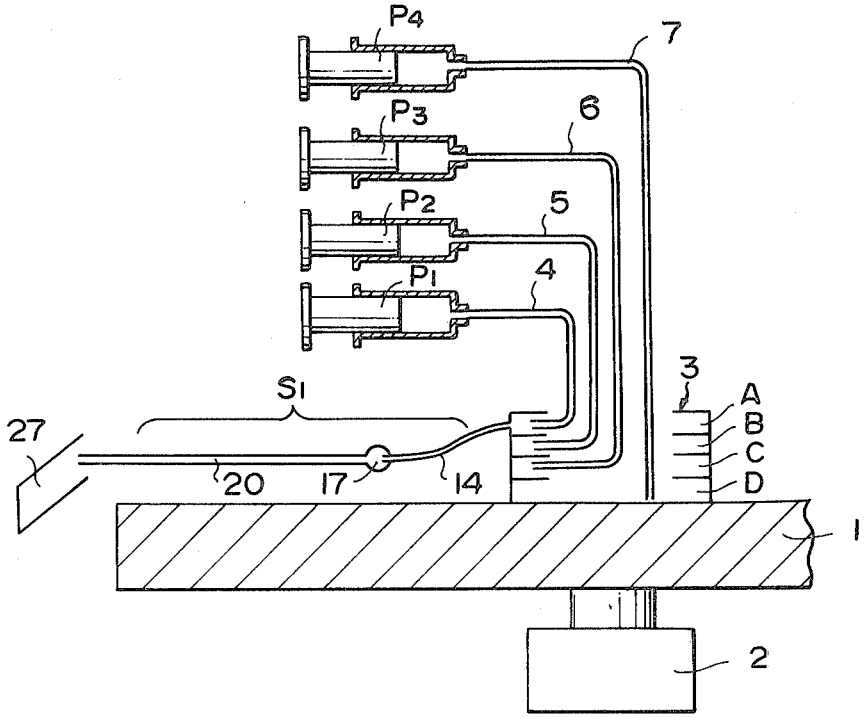
Figure 2:
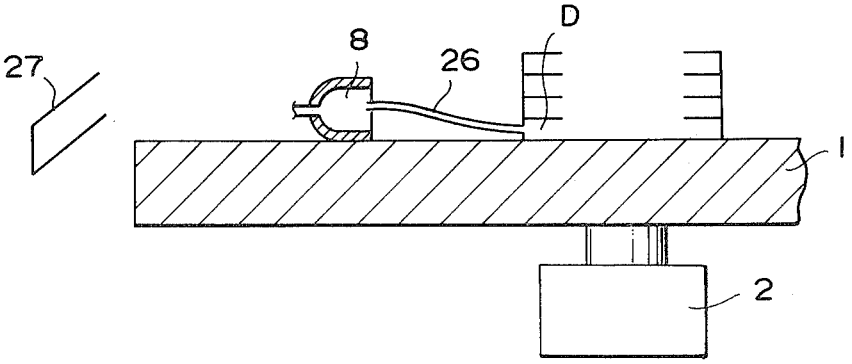

FIG. 2(III)
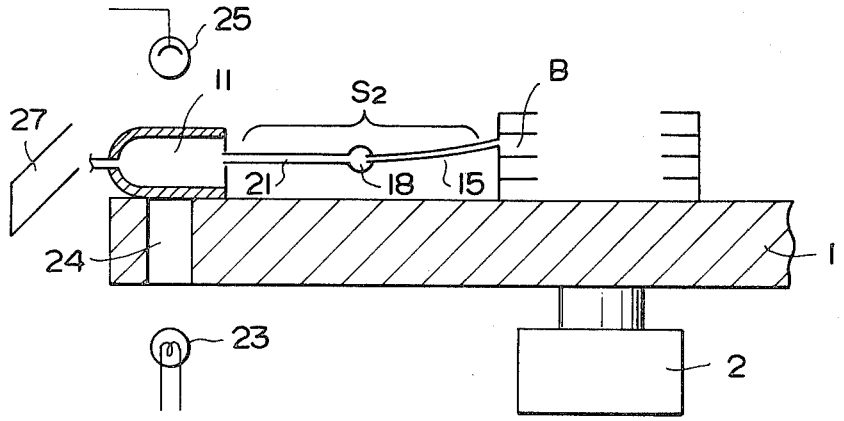
FIG. 2 (IV)
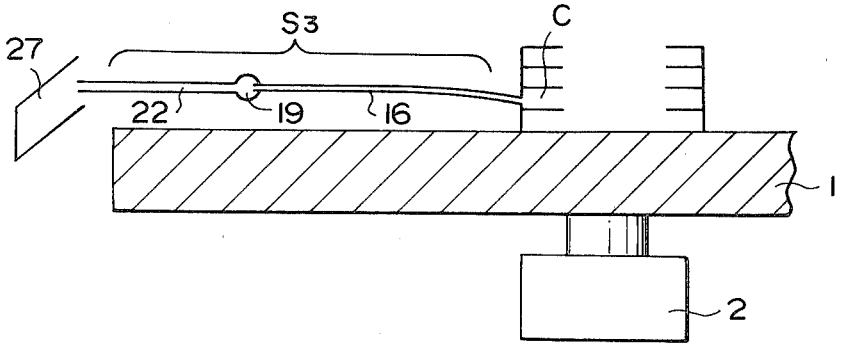

METHOD AND DEVICE FOR SEPARATELY COLLECTING COMPONENTS OF A LIQUID BY MEANS OF A CENTRIFUGAL ROTOR

BACKGROUND OF THE INVENTION

The present invention relates to a method and a device for separately collecting components of a liquid in a centrifugal rotor.

The present invention has been developed to aim at achieving the separate collection of liquid components centrifugally separated in a container mounted on a centrifugal rotor and/or the mixing of the liquid separately collected thereby with the other liquid, in very smooth and reliable manner, without using the mechanical means such as a pump. The present invention relates to a method and a device for separately collecting some components of a liquid in a container mounted on a centrifugal rotor into the other container mounted thereon or mixing said components with the components of the other liquid under the action of an aspirator provided on the centrifugal rotor during rotation thereof.

The present invention will be described in more detail with respect to the embodiments of the invention, in which not only the separate collection of the liquid, but also the discharging and the mixing of the liquids will be also described.

Figure 1:
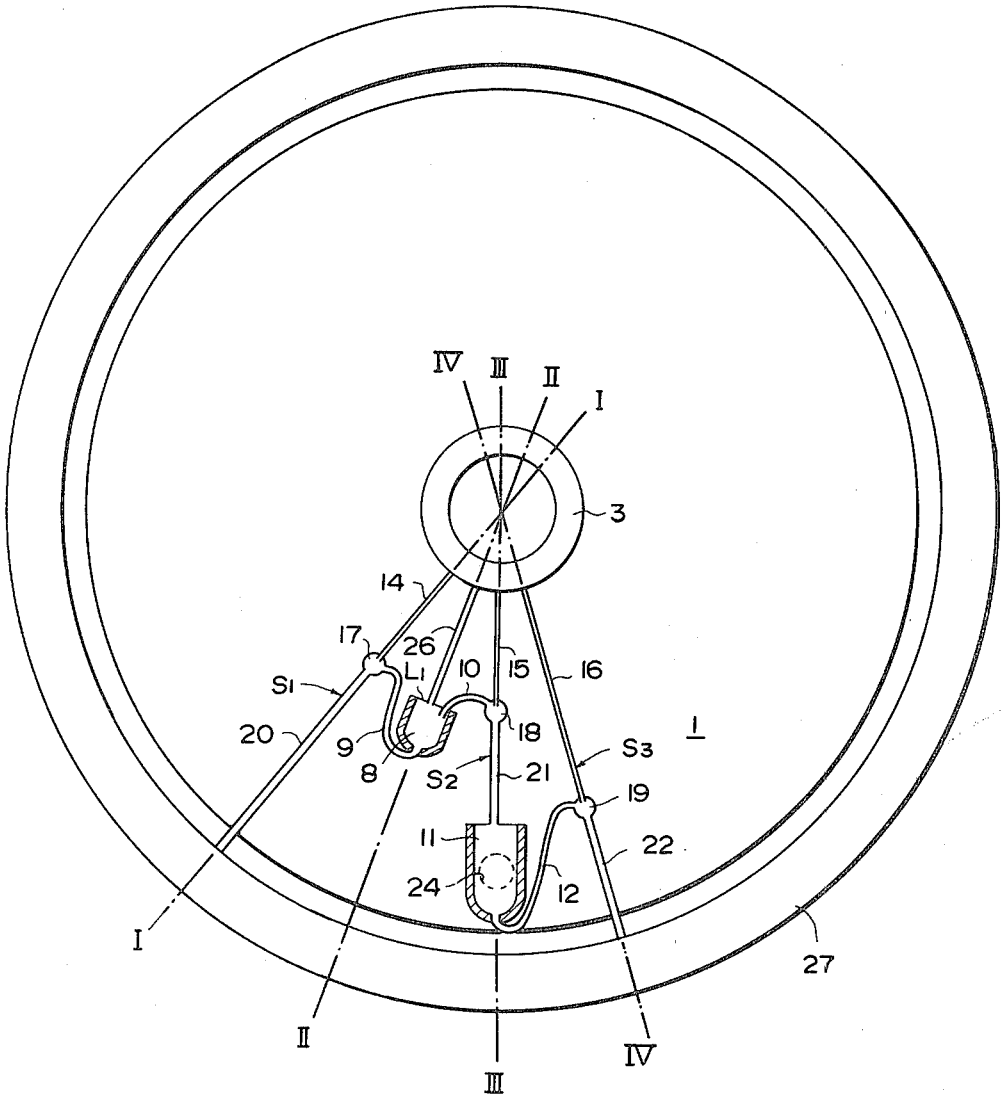
Figure 3:
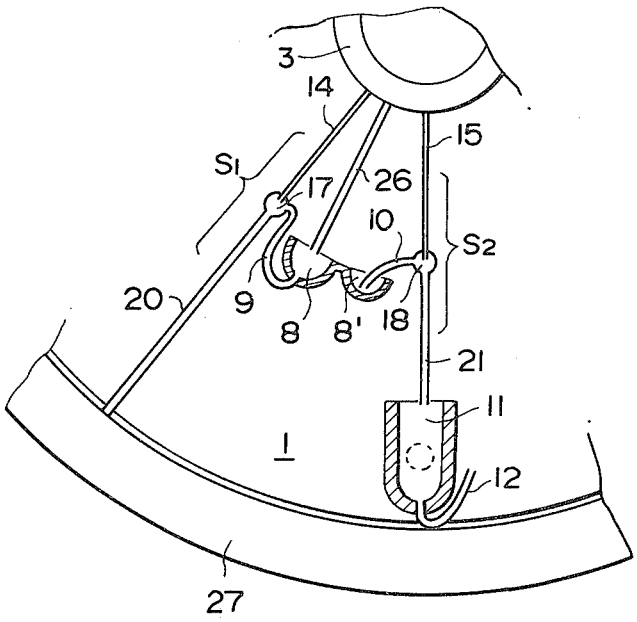

Now the present invention will be explained with reference to the drawings which illustrate the embodiments of the invention: in which FIG. 1 shows a plane view of a centrifugal rotor used in the first embodiment, FIGS. 2(I)-(IV) show cross-sectional views taken along the lines I—I, II—II, III—III and IV—IV of FIG. 1, respectively, and FIG. 3 shows a plane view of a centrifugal rotor used in the second embodiment.

FIRST EMBODIMENT

FIGS. 1 and 2 illustrate the first embodiment of the invention, which includes a centrifugal rotor 1 driven by a motor 2, having a cylindrical liquid receiver 3 centrally located on the top surface of the centrifugal rotor 1. A plurality of annular liquid receiving sections A, B, C and D are provided in the receiver 3. Liquid pouring pipes 4, 5, 6 and 7 extending from liquid pouring pumps $P_1$, $P_2$, $P_3$ and $P_4$ are arranged to discharge into the liquid receiving sections A, B, C and D, respectively.

As best seen in FIG. 2(I), a smaller diameter pipe 14 extending radially from the liquid receiving section A is provided on the top surface of the rotor, and a larger diameter drain pipe 20 is connected thereto through a spherical portion 17, so as to form an aspirator $S_1$. As used herein, the word "pipe" refers to any element for communicating fluid, for example rigid tubing, flexible hose, etc.

Similarly, as shown in FIG. 2(IV), a pipe 16 extending from the liquid receiving section C is connected to a pipe 22 through a spherical portion 19 to form an aspirator $S_3$.

Moreover, as shown in FIG. 2(III), a pipe 15 extending from the liquid receiving section B is connected to a pipe 21 through a spherical portion 18 to form an aspirator $S_2$.

A container 8 is fixed on the top surface of the rotor 1. The container 8 has an opening at the upper portion thereof facing the center of the rotor 1 and another opening at the bottom portion thereof directed towards the periphery of the rotor and hence facing in the direction of the centrifugal force. The container 8 is communicated with the spherical portion 17 of the aspirator $S_1$ through a curved pipe 9 (inner diameter 1.0 mm) which extends from the bottom opening of the container 8 via an upper position $L_1$ (which is nearer to the center of the centrifugal rotor than the upper edge of the container 8). A pipe 10 has one end inserted into the container 8, the other end of which is communicated with the spherical portion 18 of the aspirator $S_2$. A liquid feeding pipe 26 extending from the annular liquid receiving section D is inserted into the container 8 from the upper opening thereof.

The device also includes a container 11 for determining the liquid components, the container 11 being fixed on the top surface of the rotor 1 adjacent its periphery, which is arranged in a similar manner to the container 8. The container 11 is communicated with the spherical portion 19 of the aspirator $S_3$ through a curved pipe 12 having one end connected to the bottom opening of the container 11 and the other end connected to the spherical portion 19.

The container 11 is made of transparent material and a light source 23 is arranged to emit a beam of light which passes through an opening 24 formed in the rotor and through the container 11 before being received by a detector 25 which monitors the light beam received.

Thus, the annular liquid receiving sections A, B and C are communicated through the respective liquid feeding pipes 14, 15 and 16 (inner diameter 0.3 mm) with the spherical portions 17, 18 and 19, respectively. The spherical portions 17 and 18 are then communicated with the container 8 through the pipes 9 and 10 (inner diameter 1.0 mm), respectively, and the spherical portion 19 is then communicated with the container 11 through the pipe 12 (inner diameter 1.0 mm). Moreover, the pipes 20, 21 and 22 (inner diameter about 0.6 mm) extend from their associated spherical portions in the direction of the centrifugal force.

If the annular liquid receiving section A is supplied with water, the water flows into the pipe 14 and passes therethrough under the influence of the centrifugal force. Then the water flows through the spherical portion 17 into the pipe 20 and discharges therefrom. Now, consideration of the *velocity* of the water flow should be paid. It is the first essential point that the radius of revolution of the position on which the pipe 14 is located is shorter than that of the position on which the pipe 20 is located, so that the centrifugal force exerted to the water in the pipe 14 is smaller than that exerted to the water in the pipe 20, and it is the second essential point that the pipe 14 has smaller inner diameter than that of the pipe 20, so that the resistance to water flow in the pipe 14 is larger than that is the pipe 20. Thus, the water velocity in the pipe 14 is smaller than that in the pipe 20. Therefore, the pressure in the spherical portion 17 becomes negative, with the result that any content (air or liquid) of the container 8 is sucked through the pipe 9 into the aspirator until the container 8 becomes empty.

Because of the curved pipe 9, no content of the container 8 can flow through the pipe 20 before said suction.

The rotor 1 is driven at 2000 r.p.m. and 1.0 ml of human blood including a very small amount of heparin is fed from the pump $P_4$ through the pipe 7, the annular liquid receiving section D and the pipe 26 into the container 8 (having a volume of about 0.8 ml), to such extent that the human blood is overflown therefrom. Such centrifugal separation is continued for 5 minutes. Then, 1.8 ml of a buffer solution of pyrophosphoric acid (pH 8.3, 0.1 M) including nicotinamide dinucleotide ($10^{-3}$ M) and pyruvic acid ($10^{-3}$ M) is fed from the pump $P_2$ through the pipe 5, the annular liquid receiving section B and the aspirator $S_2$ into the container 11. Because of the buffer solution passing through the aspirator $S_2$, a portion (0.2 ml) of the supernatant liquid in the container 8 is sucked through the pipe 10 and mixed with the buffer solution in the container 11. Then, the nicotinamide dinucleotide in the pyrophosphoric acid buffer solution is reduced under the action of lactate dehydrogenase contained in the blood. The reaction velocity of such reduction is automatically measured in accordance with the change in the absorption of the 340 nm light beam passing through the opening 24 from the light source 23 to the detector 25 which are separately disposed from the rotor. Then, the activity of the lactate dehydrogenase in the blood (blood plasma) is measured in accordance with the change in the absorption of the light beam with the passage of time.

After this measurement, large amounts, say about 20 ml of water is fed from each of the pumps $P_1$, $P_2$, $P_3$ and $P_4$ through their respective pipes 4, 5, 6 and 7 into the liquid receiving sections A, B, C and D, respectively, so that all the liquid paths are flushed. In addition, 5 ml of water is fed from each of the pumps $P_1$ and $P_3$ into the liquid receiving sections A and C, respectively, so that the water still remaining in the containers 8 and 11 is sucked and discharged completely. Then, the device is dried to prepare for the centrifugal separation of components of fresh liquid (blood) and the measurement of the liquid components separated.

Referring to FIG. 2, a receptacle 27 for receiving the discharged liquid is arranged around the outside of the centrifugal rotor 1.

SECOND EMBODIMENT

FIG. 3 illustrates the second embodiment of the present invention in which a container 8 having a volume of about 0.3 ml is substituted for the container of the first embodiment shown in FIGS. 1 and 2, and any overflow liquid of the container 8 flows into another container 8' (having a volume of 0.1 ml), and further, one end of a pipe 10 is located in the container 8' at a position near the bottom thereof.

Using the device as constructed above, the rotor 1 is driven at 2000 r.p.m. and 0.5 ml of human blood including a very small amount of heparin is fed from the pump $P_4$ through the pipe 7, the annular liquid receiving section D and the pipe 26 into the container 8 at the liquid velocity of 0.5 ml/min, in the similar manner to the first embodiment. Then the container 8 is filled with a deposition of the blood cell and a small amount of the blood plasma at the upper portion of the container. The container 8' is filled with the blood plasma only. Then, 1.9 ml of a buffer solution of pyrophosphoric acid (pH 8.3, 0.1 M) including nicotinamide dinucleotide ($10^{-3}$ M) and pyruvic acid ($10^{-3}$ M) is fed from the pump $P_2$ through the pipe 5, the annular liquid receiving section B and the aspirator $S_2$ into the measuring container 11. The buffer solution is mixed in the measuring container 11 with the 0.1 ml (full volume of the container 8') of the blood plasma sucked through the pipe 10. The nicotinamide dinucleotide contained in the substrate solution which is mixed with the blood plasma in the measuring container 11 is reduced. The reaction velocity of such reduction is measured in the same manner as that of the first embodiment.

After this measurement, large amounts of water is fed from each of the pumps $P_1$, $P_2$, $P_3$ and $P_4$ into their respective liquid receiving sections A, B, C and D so that the containers 8, 8' and 11 as well as the pipes and the liquid paths associated therewith are flushed as in the case of the first embodiment. In addition, 5 ml of water is fed from each of the pumps $P_1$, $P_2$ and $P_3$, so that the water still remaining in the containers 8, 8' and 11 is discharged under the suction due to the aspirators. Then, the device is dried to prepare for the centrifugal separation of fresh liquid samples (blood) and the measurement of the liquid samples separated.

It will be understood from the above description that the present invention permits automatic and reliable separate collection of liquid which is poured into a centrifugal separating container mounted on a centrifugal rotor and separated thereby, and to effect the transfer of the portion of the liquid to another container mounted on the rotor, under the action of an aspirator during rotation of the centrifugal rotor, and further enables to automatically effect the complete discharging of the liquid remaining in the container and flushing of the inside of the container or the pipes arranged around the container or the like. Furthermore, the present invention permits the separate collecting, discharging, and mixing of two liquids in very economical, safe and reliable manner, without requiring the additional power and the additional structure other than those required to rotate the rotor, at the time of separate collecting, discharging and mixing of two liquids.

Since certain changes may be made in the above construction without departing from the scope of the invention, it is intended that all matter contained in the above description or shown in the accompanying drawings be interpreted as illustrative and not in a limiting sense.

Having described my invention, I claim:

1. A device for separately collecting components of a liquid, comprising:

a rotor;

a first aspirator mounted on said rotor for rotation therewith, having a radially extending smaller diameter pipe, a radially extending larger diameter pipe disposed radially outwardly from the smaller diameter pipe, and first connecting means for connecting the smaller diameter pipe and the larger diameter pipe;

a first container mounted on said rotor for rotation therewith;

a first pipe communicating between said first container and said first connecting means, wherein fluid introduced into said first aspirator is subjected to increasing centrifugal force as it flows radially outwardly for creating suction at said connecting means and thereby in said first pipe; and means for independently introducing liquids into said first aspirator and into said first container, wherein liquid may be selectively introduced into said first container for centrifuging, and wherein liquid in said first container may be selectively withdrawn through said first pipe by introducing liquid into said first aspirator.

2. A device according to claim 1, comprising a second container mounted on said rotor for rotation therewith, wherein said first aspirator is arranged to discharge fluid into said second container such that fluid in said first container may be selectively drawn off into said second container.

3. A device according to claim 2, comprising a second aspirator mounted on said rotor for rotation therewith, having a radially extending smaller diameter pipe, a radially extending larger diameter pipe disposed radially outwardly from the smaller diameter pipe, and second connecting means for connecting the smaller diameter pipe and the larger diameter pipe;

a second pipe communicating between a bottom portion of said first container and said second connecting means; and means for independently introducing fluid into said second aspirator, wherein fluid in said first container may be selectively withdrawn through said first or second aspirator.

4. A device according to claim 3 comprising:

a third aspirator mounted on said rotor for rotation therewith, having a radially extending smaller diameter pipe, a radially extending larger diameter pipe disposed radially outwardly from the smaller diameter pipe, and third connecting means for connecting the smaller diameter pipe and the larger diameter pipe;

a third pipe communicating between a bottom portion of said second container and said third connecting means; and means for independently introducing fluid into said third aspirator, wherein fluid introduced into said second container may be selectively withdrawn through said third aspirator.

5. A device according to claim 2, wherein said first container comprises two part containers, wherein one said part container is arranged to receive overflow liquid introduced into said other part container, and wherein said first pipe communicates between one of said two containers and said first connecting means.

6. A device according to claim 1 or 4, wherein each said connecting means is spherical.

7. A method for separately collecting components of a liquid using a centrifugal rotor comprising the steps of:

introducing a liquid sample into a first container mounted on said rotor for rotation therewith; and selectively withdrawing said sample from said first container, while said rotor is rotating, by (i) introducing liquid into a first aspirator mounted on said rotor for rotation therewith, said aspirator having a radially extending smaller diameter pipe, a radially extending larger diameter pipe disposed radially outwardly from the smaller diameter pipe, and first connecting means for connecting the smaller diameter pipe and the larger diameter pipe; and by (ii) communicating said first container to said first connecting means, wherein liquid introduced into said rotating first aspirator is subjected to increasing centrifugal force and flows radially outwardly for creating suction at said first connecting means for withdrawing said sample from said first container.

8. A method according to claim 7, comprising the step of discharging said sample and said liquid from said first aspirator into a second container, mounted on said rotor for rotation therewith, for analysis thereof.

9. A method according to claim 8, comprising the steps of flushing said first and second containers, while said rotor is rotating, by (i) introducing a flushing liquid into each container; (ii) introducing liquid into second and third aspirators, each mounted on said rotor for rotation therewith and having a radially extending smaller diameter pipe, a radially extending larger diameter pipe disposed radially outwardly from the smaller diameter pipe, and connecting means for connecting the smaller diameter pipe and the larger diameter pipe; and (iii) communicating said second and third aspirators with a bottom portion of said first and second containers, respectively.

* * * * *